US006791564B1

(12) United States Patent
Elliott et al.

(10) Patent No.: US 6,791,564 B1
(45) Date of Patent: Sep. 14, 2004

(54) MECHANISM FOR CLIPPING RGB VALUE DURING INTEGER TRANSFER

(75) Inventors: Timothy A. Elliott, Austin, TX (US); G. Glenn Henry, Austin, TX (US)

(73) Assignee: IPFirst, LLC, Fremont, CA (US)

( * ) Notice: Subject to any disclaimer, the term of this patent is extended or adjusted under 35 U.S.C. 154(b) by 0 days.

(21) Appl. No.: 09/565,834

(22) Filed: May 5, 2000

(51) Int. Cl.[7] ..... G09G 5/02
(52) U.S. Cl. ..... 345/589; 345/605
(58) Field of Search ..... 345/643, 522, 345/589, 426, 600, 605, 593, 501–506; 708/505

(56) References Cited

U.S. PATENT DOCUMENTS

| | | | | |
|---|---|---|---|---|
| 4,338,675 A | | 7/1982 | Palmer et al. | |
| 5,125,094 A | | 6/1992 | Kyuma | |
| 5,257,215 A | | 10/1993 | Poon | |
| 5,390,307 A | | 2/1995 | Yoshida | |
| 5,465,373 A | | 11/1995 | Kahle et al. | |
| 5,506,957 A | | 4/1996 | Fry et al. | |
| 5,568,380 A | | 10/1996 | Brodnax et al. | |
| 5,619,667 A | | 4/1997 | Henry et al. | |
| 5,664,215 A | | 9/1997 | Burgess et al. | |
| 5,696,709 A | | 12/1997 | Smith, Sr. | |
| 5,734,874 A | | 3/1998 | Van Hook et al. | |
| 5,740,466 A | | 4/1998 | Geldman et al. | |
| 5,793,944 A | | 8/1998 | Luick | |
| 5,812,868 A | | 9/1998 | Moyer et al. | |
| 5,856,829 A | | 1/1999 | Gray, III et al. | |
| 5,856,831 A | * | 1/1999 | Scott et al. | 345/503 |
| 5,878,266 A | | 3/1999 | Goddard et al. | |
| 5,913,054 A | | 6/1999 | Mallick et al. | |
| 5,926,642 A | | 7/1999 | Favor | |
| 5,938,756 A | * | 8/1999 | Van Hook et al. | 345/502 |
| 5,940,311 A | | 8/1999 | Dao et al. | |
| 5,961,629 A | | 10/1999 | Nguyen | |
| 6,014,739 A | | 1/2000 | Christie | |
| 6,058,410 A | | 5/2000 | Sharangpani | |
| 6,145,049 A | | 11/2000 | Wong | |
| 6,166,748 A | * | 12/2000 | Van Hook et al. | 345/522 |
| 6,205,543 B1 | | 3/2001 | Tremblay et al. | |
| 6,289,417 B1 | | 9/2001 | Larri | |
| 6,330,657 B1 | | 12/2001 | Col et al. | |
| 6,397,239 B2 | * | 5/2002 | Oberman et al. | 708/505 |
| 6,397,293 B2 | | 5/2002 | Shrader et al. | |
| 6,484,254 B1 | | 11/2002 | Chowdhury et al. | |
| 6,614,448 B1 | * | 9/2003 | Garlick et al. | 345/605 |

* cited by examiner

*Primary Examiner*—Michael Razavi
*Assistant Examiner*—Chante Harrison
(74) *Attorney, Agent, or Firm*—David Hitt; James W. Huffman

(57) ABSTRACT

A mechanism for, and method of, clipping a red-green-blue (RGB) integer value to an n-bit maximum value and a processor incorporating the mechanism or the method. In one embodiment, the mechanism includes: (1) a multiplexer having a first input that accepts n low-order bits of the RGB integer value and a select input that accepts at least one high-order bit of the RGB integer value and (2) an n-bit maximum value generator, coupled to a second input of the multiplexer, that provides the n-bit maximum value to the second input, an output of the multiplexer providing the n low-order bits when the at least one high order bit has a zero value and providing the n-bit maximum value when the at least one high order bit has a nonzero value.

7 Claims, 4 Drawing Sheets

MECHANISM FOR CLIPPING RGB VALUE DURING INTEGER TRANSFER

TECHNICAL FIELD OF THE INVENTION

The present invention is directed, in general, to computer processors and, more specifically, to a mechanism for clipping RGB values to at most an acceptable maximum during integer transfer.

BACKGROUND OF THE INVENTION

Modern computer systems use a number of different processor architectures to execute software programs. In conventional microprocessor-based systems, a computer program is made up of a number of macro instructions that are provided to the microprocessor for execution. The microprocessor decodes each macro instruction into a sequence of micro instructions, i.e., more elemental machine instructions that the microprocessor is capable of executing individually, and executes the micro instructions in the sequence.

Most processors include a floating-point unit (FPU) to assist in the processing of numbers expressed in floating-point form (mantissa and exponent). Such numbers are often encountered in complex numerical analyses that the processor may be called upon to perform. Because an FPU is specially adapted to process such numbers, it serves to make the microprocessor faster overall. FPUs for microprocessors were originally introduced as a part of a math coprocessor that operated in tandem with the microprocessor. Now, FPUs are often incorporated into microprocessors.

FPUs are frequently called upon to make repetitive calculations. One important calculation is determining color values that are to be displayed on a monitor.

Colors are commonly represented by three independent values. With so-called "RGB" monitors, one value represents red, another green and yet another blue. With various concentrations of these three primary colors, one can in theory create any hue in the spectrum of visible light.

However, since a computer only uses a finite set of values for each of these three colors, only a finite set of colors can be produced. For example, an EGA, one of the earlier graphics adapters that could produce RGB color, employed two bits each for red, green and blue. Therefore, red, green and blue could each take four values, giving a maximum of 64 colors. Most standard computers today represent red, green and blue in eight bits yielding 256 possible intensity levels. Therefore, approximately 16 million colors can be created with different combinations of red, green and blue intensity.

The values of these colors may be determined by either hardware or software. Sometimes, the numbers initially used to represent color values are expressed as floating-point numbers. However, a conversion to 8-bit integer form should take place before the colors represented by these values can be displayed.

To perform this conversion, prior art microprocessors employed two separate microcode-based clipping functions to convert each value. The clipping functions operated thus: if the color value was too high (over 255, when an 8-bit integer result is desired), the register corresponding to that color and position was set to 255. If the value was too low (below 0), the register was set to 0.

The FPU might use microcode, such as the following, to accomplish this clipping:

```
If (Red)>255 Red==255

If (Red)< Red==0
```

Therefore, the FPU was required to execute two separate inequality operations when faced with inappropriate values for the colors of course, each of these inequality operations requires processor time.

The number of times the FPU performs these calculations is such that any savings in time in performing these steps of the calculations would be advantageous. Accordingly, what is needed in the art is a mechanism that can perform an RGB clipping function with greater efficiency.

SUMMARY OF THE INVENTION

To address the above-discussed deficiencies of the prior art, the present invention provides a mechanism for, and method of, clipping an RGB integer value to an n-bit maximum value and a processor incorporating the mechanism or the method. In one embodiment, the mechanism includes: (1) a multiplexer having a first input that accepts n low-order bits of the RGB integer value and a select input that accepts at least one high-order bit of the RGB integer value and (2) an n-bit maximum value generator, coupled to a second input of the multiplexer, that provides the n-bit maximum value to the second input, an output of the multiplexer providing the n low-order bits when the at least one high order bit has a zero value and providing the n-bit maximum value when the at least one high order bit has a nonzero value.

The present invention therefore introduces the broad concept of employing highbit-select logic to perform RGB value-clipping in hardware, rather than by separate software instruction.

In one embodiment of the present invention, n equals eight. This means that the n-bit maximum value is 255, which is a standard maximum RGB value. Of course, the present invention is not limited to a particular value for n.

In one embodiment of the present invention, the select input accepts eight low-order bits of the RGB integer value. Again, this corresponds to a value of at most 255. In an embodiment to be illustrated and described, all of the remaining (high-order) bits are provided to the select input. In the case of a 16-bit incoming RGB integer value, the lower 8 bits are accepted into the first input and the upper 8 bits are accepted into the select input. Of course, this need not be the case.

In one embodiment of the present invention, the multiplexer accepts the RGB integer value from a floating-point register. In two embodiments to be illustrated and described, the floating-point register contains the RGB value in 16-bit integer form. Alternatively, the incoming RGB integer value can be accepted from an integer register.

In one embodiment of the present invention, the output is coupled to an n-bit integer register. If n equals 8, then the register is, but is not required to be, 8 bits wide.

In one embodiment of the present invention, the n-bit maximum value generator comprises a voltage source coupled to the second input. In an embodiment to be illustrated and described, all of the lines of the second input are set to a logical one, thereby generating the n-bit maximum value (255 in the embodiment to be illustrated and described).

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
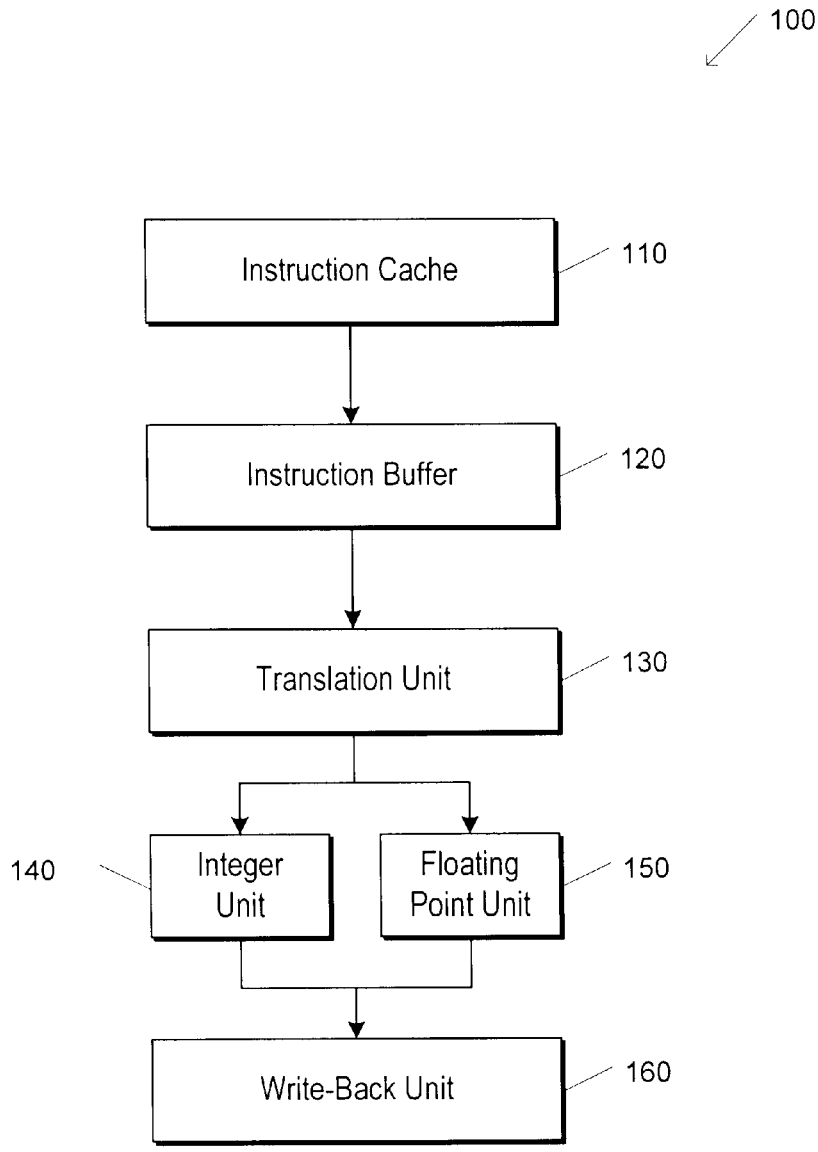
FIG. 1 illustrates a schematic block diagram of a processor that incorporates a mechanism capable of clipping an integer value constructed according to the principles of the present invention.

Referring initially to FIG. 1, illustrated is a schematic block diagram of a processor 100 that can incorporate a floating-point register file structure, having shared-split register files, constructed according to the principles of the present invention. FIG. 1 is presented primarily for the purpose of showing the path that an integer or floating point instruction follows through the processor 100.

An instruction cache 110 holds a macro instruction (not shown) for carrying out logical and mathematical operations with respect to integers and floating point numbers. Of course, these macro instructions can include a macro instruction calling for a floating point operation to be performed, perhaps during the course of solving a transcendental function.

The macro instruction proceeds to an instruction buffer 120 that holds the macro instruction until it is summoned for translation in a translation unit 130. In the translation unit 130, the macro instruction is translated into a set of micro instructions suitable for direct execution by the processor 100.

After leaving the translation unit 130, the set of micro instructions goes to either an integer unit 140 or an FPU 150 for processing. Finally, a write-back unit 160 stores results stemming from execution of the set of micro instructions in result buffers (not shown) until the results are "written back" to appropriate places.

Figure 2:
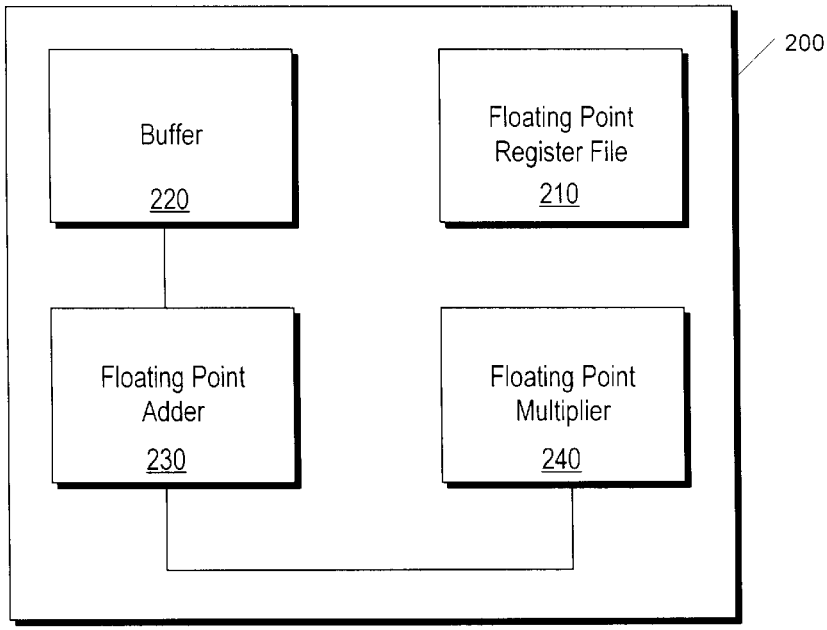
FIG. 2 illustrates a block diagram of an exemplary floating-point arithmetic unit that can contain the mechanism of FIG. 1.

Turning now to FIG. 2, illustrated is a block diagram of an exemplary FPU 200 that can contain a floating-point register file structure constructed according to the principles of the present invention. The FPU 200 includes a floating point register file 210 (having a stack architecture, although the present invention is not so limited). Coupled to the floating-point register file 210 is a buffer 220 designed to hold floating-point micro instructions (opcodes and associated operands and targets).

Coupled to the buffer 220 are a floating-point adder 230 and a floating-point multiplier 240. If the floating-point micro instruction being executed calls for operands to be added (or subtracted), the operands are provided from the floating-point register file 210 to the floating-point adder 230 for use thereby. The floating-point adder 230 performs its mathematical operation on the two numbers and provides the result thereof to a target in the floating-point register file 210 specified by the floating-point micro instruction being executed.

Likewise, if the floating-point micro instruction being executed calls for operands to be multiplied (or divided), the operands are provided from the floating-point register file 210 to the floating-point multiplier 240 for use thereby. The floating-point multiplier 240 performs its mathematical operation on the two numbers and provides the result thereof to a target in the floating-point register file 210 specified by the floating-point instruction being executed.

At this point, it should be noted that the registers within the floating point register file 210 are capable of storing a number in integer form, as well as in floating point form. A complete description of a floating point register file having this capability is described in U.S. Pat. No. 6,253,311, entitled "Instruction Set for Bidirectional Conversion and Transfer of Integer and Floating Point Data." commonly assigned with the present invention and incorporated herein by reference.

This architectural feature allows the floating-point register file 210 to contain an integer number representing a color intensity. As previously stated, it is an object of the present invention to ensure that the integer number is clipped to an allowable maximum before being employed to drive a monitor.

Figure 3:
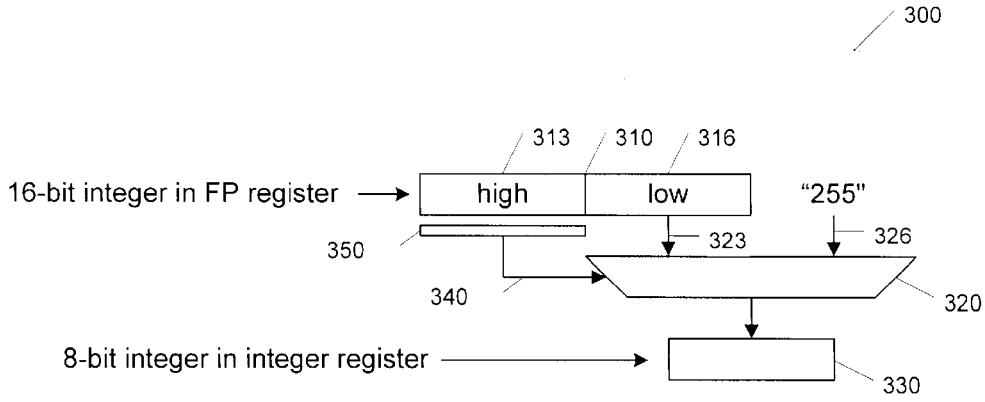
FIG. 3 illustrates a mechanism for clipping an integer value constructed according to the principles of the present invention.

Turning now to FIG. 3, illustrated is a mechanism 300 for clipping an integer value constructed according to the principles of the present invention. The mechanism 300 includes an unsigned 16-bit floating-point register 310 that is divided into two parts: eight high bits 313 and eight low bits 316. The unsigned 16-bit floating-point register 310 is instructed to pass its value to a multiplexer 320. The multiplexer 320, in turn, is instructed to pass the appropriate 8-bit value to an 8-bit integer register 330. The unsigned 16-bit floating-point register 310 contains a number that corresponds to a desired value of color. The color value could represent red, green or blue or any other color, luminance or chrominance.

The multiplexer 320 is a conventional 16/8 multiplexer. Those skilled in the art are familiar with the properties and uses of multiplexers in general. The multiplexer 320 includes first and second inputs 323, 326 and a select bit 340. The first input 323 is comprised of the eight low bits 316 of the unsigned 16-bit floating-point register 310. The second input 326 is simply an integer representing the number "255." The select bit 340 is derived from a logical "OR" of the eight high bits 313, and instructs the multiplexer 320 whether to select the eight low bits 316 or simply the number "255" as its output.

In the illustrated embodiment of the present invention, a logic circuit 350 (consisting, in one embodiment, of a plurality of cascading OR gates) is employed to determine whether any of the eight high bits 313 are ON, or "1." If any one of the eight high bits 313 is "1," the select bit 340 is set to "1." Otherwise, the select bit 340 is set to OFF, or "0."

If the select bit 340 is set to "1," the multiplexer 320 is instructed that the number in the 16-bit floating-point register 310 is greater than "255." Because the number in the 16-bit floating-point register 310 is greater than 255, the multiplexer 320 provides an output value of "255" to the 8-bit integer register 330.

If, on the other hand, none of the eight high bits 313 of the 16-bit floating-point register 310 is "1," the select bit 340 is "0," which instructs the multiplexer 320 that the number in the 16-bit floating-point register 310 is less than or equal to "255." Because the value in the 16-bit floating-point register 310 is less than or equal to "255," the value is within the allowable range. Therefore, the multiplexer 320 simply provide the low bits 316 to the 8-bit integer register 330.

Figure 4:
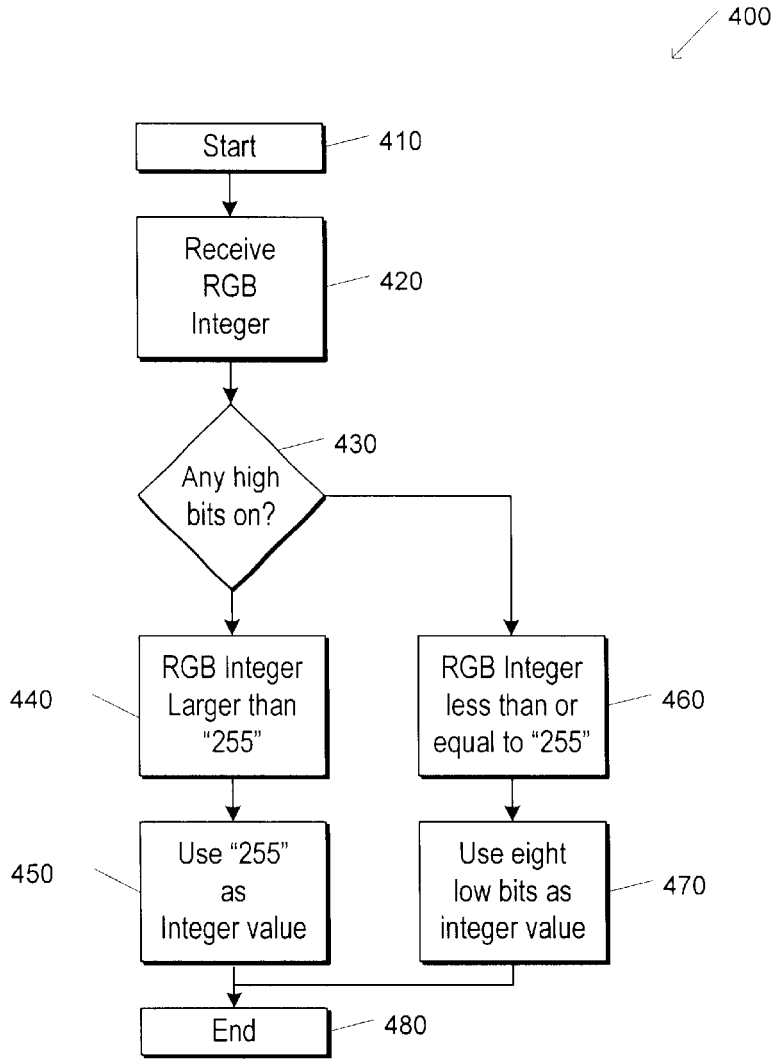
FIG. 4 illustrates a flow diagram representing a method of clipping an RGB value during integer transfer carried out according to the principles of the present invention.

Turning now to FIG. 4, illustrated is a flow diagram, generally designated 400, representing a method of clipping an RGB value during integer transfer constructed according to the principles of the present invention. The method begins at a start step 410.

A 16-bit integer representing the RGB value is first received in a floating-point register during in a step 420. Next, in a decisional step 430, it is determined whether any of the 8 high bits in the 16-bit RGB integer are "1." If so, the 16-bit RGB integer is larger than "255," and processing continues to a step 440, wherein the multiplexer selects the second input, representing the value of "255." In a step 450, the multiplexer then provides the value of "255" as its output. The method concludes in an end step 480.

If the result of the decisional step 430 is NO, the 16-bit RGB integer is less than or equal to "255." and processing continues to a step 470, wherein the multiplexer selects the first input, representing the value of the eight low bits, and provides the value represented by the eight low bits as its output. Then, as before, the method concludes in the end step 480.

Although the present invention has been described in detail, those skilled in the art should understand that they can make various changes, substitutions and alterations herein without departing from the spirit and scope of the invention in its broadest form.

What is claimed is:

1. A mechanism for clipping a red-green-blue (RGB) integer value stored within a floating point register to an 8-bit maximum value of 255, comprising:

a multiplexer having a first input that accepts n. low-order bits of said RGB integer value from the floating point register, and a select input that accepts at least one high-order bit of said RGB integer value as a mux select; and an 8-bit maximum value generator, coupled to a second input of said multiplexer, that provides the maximum value of 255 to said second input, an output of said multiplexer providing said n low-order bits when said at least one high order bit has a zero value and providing said maximum value of 255 when said at least one high order bit hats a nonzero value.

2. The mechanism as recited in claim 1 wherein said n equals eight.

3. The mechanism as recited in claim 1 wherein said select input accepts eight high-order bits of said RGB integer value.

4. The mechanism as recited in claim 1 wherein said output is coupled to an n-bit integer register.

5. The mechanism as recited in claim 1 wherein said n-bit maximum value generator comprises a fixed value of 255 coupled to said second input.

6. A method of clipping a red-green-blue (RGB) 16-bit integer value stored within a floating point register to an 8-bit maximum value of 255, comprising:

providing a multiplexer to select between 8 low-order bits of the 16-bit integer value from the floating point register, and the 8-bit maximum value of 255, to be provided at the multiplexer's output;

providing the 8 low-order bits of the RGB integer value to a first input of the multiplexer;

providing the 8-bit maximum value of 255 to a second input of the multiplexer;

providing at least one of the 8 high-order bits of the 16-bit integer value to a select input on the multiplexer;

providing the 8-bit maximum value of 255 at the multiplexer's output when the at least one of the 8 high-order bits has a nonzero value; and providing the 8 low-order bits of the 16-bit integer value at the multiplexer's output when the provided one of the at least one of the 8 high-order bits of the 16-bit integer has a zero value;

wherein by utilizing the 8 high-order bits of the RGB 16-bit integer value as the select input to the multiplexer, the RGB 16-bit integer value is clipped to the maximum value of 255 whenever the value of the RGB 16-bit integer value is greater than 255.

7. A microprocessor, comprising:

an instruction cache that stores macro instructions;

a translator, connected to said instruction cache, that retrieves said macro instructions from said instruction cache and translates said macro instructions into a plurality of micro instructions, some of said micro instructions calling for calculation of red-green-blue (RGB) values;

an instruction register, connected to said translator, that stores said plurality of micro instructions for execution in later stages in said processor; and a floating-point arithmetic unit, connected to said instruction register, that receives said plurality of micro instructions, said floating-point arithmetic unit containing an apparatus for clipping a 16-bit RGB integer stored within a floating -point register file to an 8-bit maximum value, the apparatus comprising:

a multiplexer having a first input that accepts 8 low-order bits of said RGB integer from the floating point register and a select input that accepts at least one high-order bit of said RGB integer, and r an 8-bit maximum value generator, coupled to a second input of said multiplexer, that provides said 8-bit maximum value to said second input, an output of said multiplexer providing said 8 low-order bits when said at least one high-order bit has a zero value and providing said 8-bit maximum value when said at least one high-order bit has a nonzero value;

wherein by utilizing said 8 high-order bits of said 16-bit RGB integer as the select input to said multiplexer, the 16-bit RGB integer is clipped to the 8-bit maximum value whenever the value of the 16-bit RGB integer is greater than 255.

* * * * *